US005558018A

United States Patent [19]

Leinonen

[11] Patent Number: 5,558,018

[45] Date of Patent: Sep. 24, 1996

[54] SUPPORT FRAME FOR NIP ROLLERS

[75] Inventor: Erkki Leinonen, Järvenpää, Finland

[73] Assignee: Valmet Corporation, Helsinki, Finland

[21] Appl. No.: 477,793

[22] Filed: Jun. 7, 1995

[30] Foreign Application Priority Data

Jun. 15, 1994 [FI] Finland ..... 942858

[51] Int. Cl.[6] ..... B30B 3/04

[52] U.S. Cl. ..... 100/170; 72/232; 72/245; 100/163 A

[58] Field of Search ..... 100/161, 162, 100/163 R, 163 A, 164, 165, 170; 72/232, 245

[56] References Cited

U.S. PATENT DOCUMENTS

| | | | |
|---|---|---|---|
| 1,575,539 | 3/1926 | Butterworth, Jr. | 100/163 A |
| 2,601,794 | 7/1952 | Wood | 72/232 |
| 2,758,466 | 8/1956 | Belcher | 100/170 |
| 3,016,819 | 1/1962 | Kupka | 100/163 A |
| 3,027,827 | 4/1962 | Stone | 100/162 R |
| 3,340,796 | 9/1967 | Link | 100/162 R |
| 3,578,766 | 5/1971 | Diolet | 100/170 |
| 3,667,272 | 6/1972 | Maltby | 72/245 |
| 4,580,429 | 4/1986 | Gilvar | 72/245 |

FOREIGN PATENT DOCUMENTS 2427914 1/1976 Germany .

*Primary Examiner*—Stephen F. Gerrity
*Attorney, Agent, or Firm*—Cohen, Pontani, Lieberman, Pavane

[57] ABSTRACT

A frame structure for calenders in a paper machine in which two vertical legs are horizontally connected to one another. The calender rolls are mounted, one above the other, between the vertical legs so that the upper roller is fixed vertically while the lower roller is able to slide vertically. A loading cylinder is used to move the lower cylinder vertically within the frame. The loading cylinder is mounted on a beam structure which is attached at its ends to the inner walls of the frame legs. The beam structure is shaped so that it is able to flex or pivot relative to the frame's legs so that only vertical forces are transmitted to the frame and transmission of bending moments from the beam structure to the frame structure and the foundation is substantially eliminated.

8 Claims, 3 Drawing Sheets

SUPPORT FRAME FOR NIP ROLLERS

FIELD OF THE INVENTION

The present invention relates to a frame for calenders, presses and similar finishing equipment for a paper sheet having at least two rolls forming a roll nip.

BACKGROUND OF THE INVENTION

Paper sheet is finished using surface smoothing equipment capable of modifying the paper surface quality. The most typical of such machines are soft-calenders, which are principally adapted as on-machine units. Such units run at the web speed of the paper machine and have a width equal to that of the paper machine.

The rolls of calenders and presses are loaded against each other at the roll ends by means of hydraulic cylinders acting on the bearing housings of the rolls. Calenders in particular require high compressive forces which are applied or backed by the frame of the equipment, and finally, the foundation thereof. In conventional frames, the forces applied by the loading cylinders are backed almost directly by the foundation structures of the equipment, thus requiring that the foundations of the equipment be extremely strong, but nevertheless subjecting the foundation to the risk of fractures and other damage.

In a prior-art frame construction, the loading cylinder is positioned between the bottom rail of the frame and the housings of the roll end bearings. In this design, the frame is stressed at its center with a high positive support force which is directly transmitted to the foundation, while the legs of the calender frame are correspondingly stressed by negative support forces. As the calender loading forces are directly transmitted to the foundation structures, the loading force of the calender tends to dislodge the frame and thus the equipment from its foundation because the loading force imposes a direct tensional stress on the foundation anchor bolts and mounting fixtures located at the ends of the frame legs.

In another prior-art frame design, the equipment frame is shaped as a continuous U-section. The loading cylinder is mounted to the bottom rail of the U-flame, and the bottom rail is supported a distance above the floor and the foundation structures. In this design, the loading forces cause both tension and bending stresses on the mounting elements at the frame legs. The bending moment results in a torque stress which is transmitted to the anchor bolts of the frame leg ends and to the foundation, thus causing an extremely high load on the foundation structures. The loading conditions will be particularly accentuated when the nip is opened quickly, whereby the internal stresses of the frame are rapidly relieved and the direction of the forces is changed causing a high transient stress to be imparted to the foundation structures.

Wide and fast paper machines impart high static loads to the foundations, and the level of dynamic stresses is further increased by reaction forces which are transmitted to the foundation during operation of the machine.

SUMMARY OF THE INVENTION

An object of the present invention is to provide a frame construction for rollers in which the loading forces are retained as internal forces of the frame and the loading forces are not transmitted to the foundation structures.

The aforesaid object of the present invention is accomplished by supporting the loading cylinder with the frame legs by means of a support structure which behaves like a beam structure which is center-loaded and pivotally jointed proximate to its ends where it is connected to the frame.

The frame of the present invention reduces the stresses in the support structures, whereby the design and structure of the foundation is simpler. Furthermore, with such lower stresses, the frequency of repairs and maintenance checks are reduced. The frame of the present invention is particularly suited for use in many different types of equipment. Its assembly is relatively simple and therefore does not significantly increase the manufacturing cost of the frame.

The rolls are mounted, one above the other, between the vertical legs of the frame so that the upper roller is fixed vertically while the lower roller is able to slide vertically. Both rollers are mounted so that they are able to rotate freely about their respective axes. A loading cylinder is used to move the lower cylinder vertically within the frame. The loading cylinder is mounted on a beam structure which is attached at its ends to the inner walls of the frame legs. The beam structure is shaped so that it is able to flex or pivot relative to the frame's legs so that only vertical forces are transmitted to the frame, and transmission of bending moments from the beam structure to the frame structure and the foundation is substantially eliminated.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENT

Figure 1:
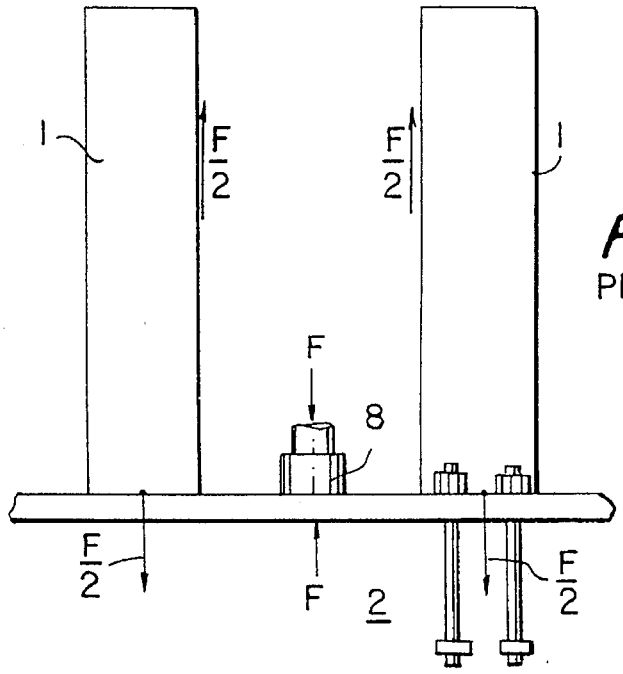
FIG. 1 PRIOR ART
FIG. 1 is a schematic drawing of a first prior art frame structure showing the effect of a loading force F.

Referring to FIG. 1, a prior art frame is schematically illustrated in which the loading cylinder 8 is directly mounted onto or backed by the equipment foundation 2. A pair of rollers (not shown) are mounted between the frame legs 1, one above the other to form a roll nip, so that the lower roller is rotatably supported between frame legs 1 and at least indirectly supported by the loading cylinder 8. The upper roll is rotatably supported between and by the two frame legs 1. By actuating the loading cylinder 8 so that it extends with a loading force F, the lower roll is forced toward the upper roll 1. The anchoring of the frame legs 1 is subjected to a tensional stress which is half of the force F applied by means of the loading cylinder 8. At the loading cylinder 8, the foundation 2 is subjected to a backing force F equal to the loading force. The tensional stress of the frame legs 1 is thus half the loading force, that is, F/2. Thus, the frame is stressed at its center (below loading cylinder 8) with a high positive support force which is directly transmitted to the foundation 2, while the legs 1 of the frame are stressed by negative support forces. These opposed forces tend to dislodge the frame from its foundation.

Figure 2:
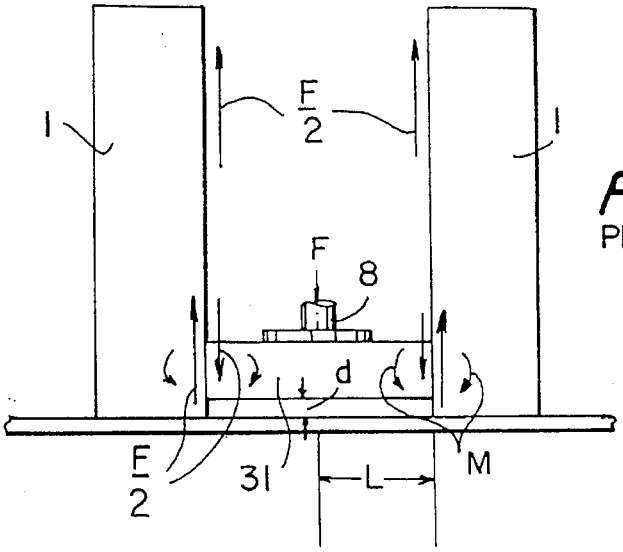
FIG. 2 PRIOR ART
FIG. 2 is a schematic drawing of a second prior art frame structure showing the effect of a loading force F.

Referring to FIG. 2, another prior art frame is schematically illustrated. In this frame design, the frame is formed substantially in the shape of a U. The loading cylinder 8 is mounted to a support plate 3 1 which is secured at its ends to the frame legs 1. The support plate 31 is supported at a distance d above the floor and/or the foundation structures.

Although this frame design avoids transmitting the tensional stress directly to the foundation, its disadvantage is that at the joint between the support plate 31 and the frame legs 1, a torsional or bending moment M is formed which is half the loading force F multiplied by the distance L between the center of the loading cylinder 8 and the joint. This bending moment M stresses the foundation upon each application of the loading force F, and particularly during rapid openings of the roll nip when the direction of the bending moment is reversed quickly, whereby the foundation is subjected to high dynamic stresses which may detach the frame from the foundation.

Figure 3:
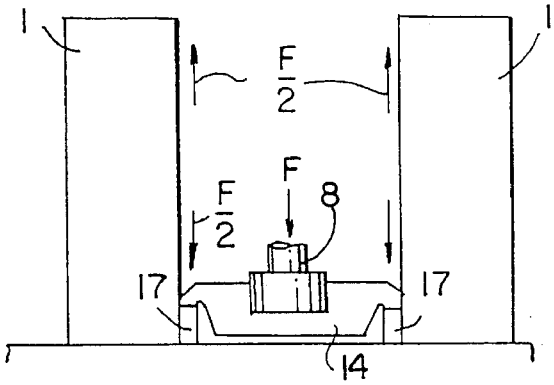
FIG. 3 is a schematic drawing of an embodiment of the frame of the present invention showing the effect of a loading force F.

Referring to FIG. 3, a frame structure according to the present invention is schematically illustrated in which the joint between the support plate 14 upon which the loading cylinder 8 is mounted and the frame legs 1 is provided with a pivotally acting joint which prevents the transmission of any bending moment across the joint. Hence, the transmission of internal forces along the frame legs 1 occurs primarily through the inner walls of the legs 1 and the stresses imposed by the backing forces of the loading cylinder 8 on the foundation are minimized.

Figure 4:
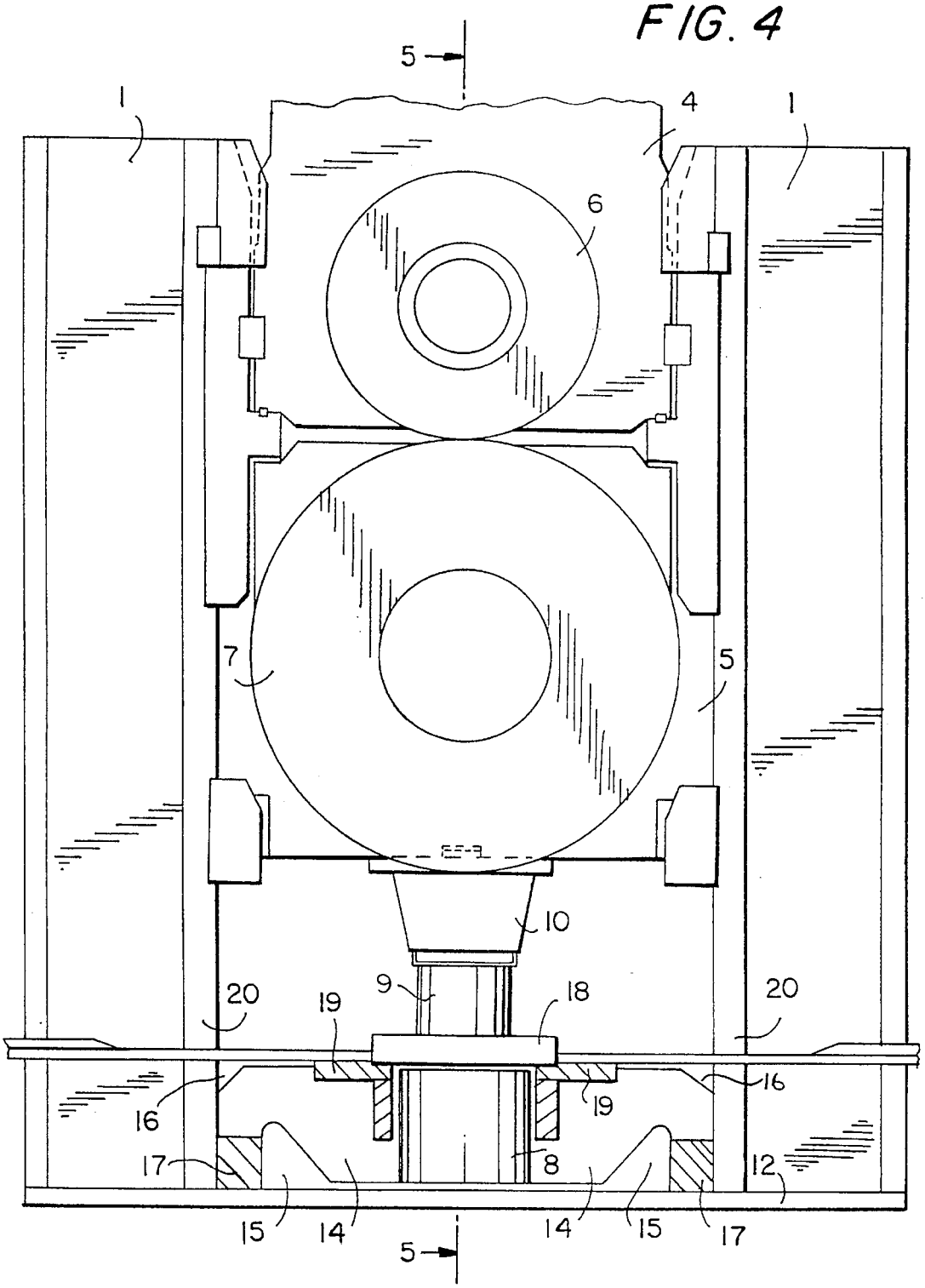
FIG. 4 is a partial sectional side elevational drawing of a frame according to an embodiment of the present invention.
Figure 5:
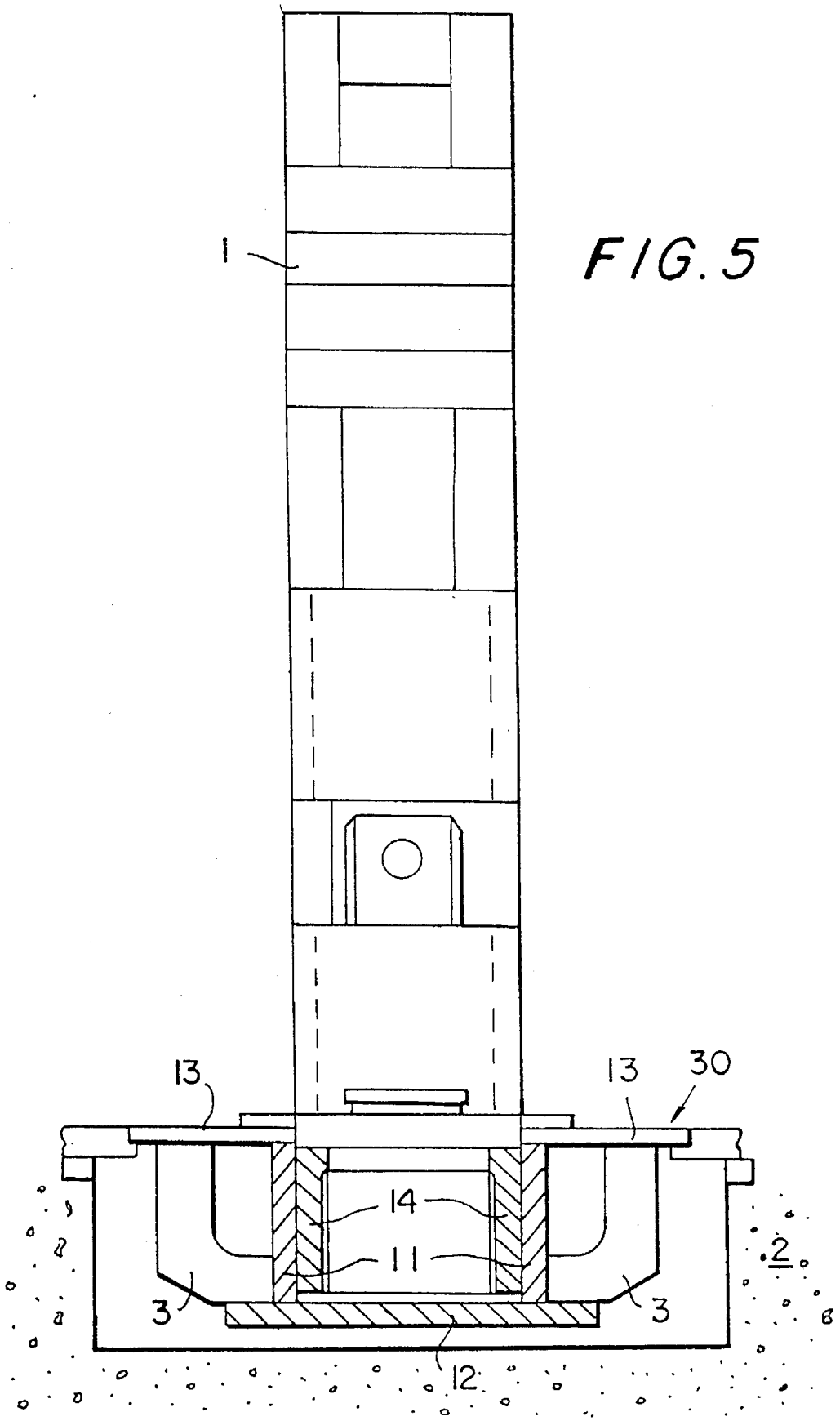
FIG. 5 is a cross-sectional drawing of the embodiment shown in FIG. 4 taken along line 5—5.

Referring to FIGS. 4 and 5 in which the embodiment shown in FIG. 3 is shown in detail, the frame of a nipped roll pair is shown. A single piece of equipment may have a number of successive roll pairs. In the following description, it is to be understood that the frame structure is described for supporting one end of the rollers. The frame is preferably symmetrical at both ends of the rollers.

The frame structure comprises two vertical legs 1 and a beam structure tying together the bottom ends of the legs 1. The legs 1 are fabricated as a hollow-section column or are cut from a suitable continuous section. Two bearing housings 4, 5 are mounted between the two legs 1 one of which supports an upper hard backing roll 6 and the other of which supports a softer lower roll 7 which is positioned below the upper backing roll 6. The upper roll 6 is rotatably mounted in bearing housing 4 so that it is stationary relative to the legs 1, while the soft lower roll 7 is rotatably mounted in bearing housing 5 so that it is slidably mounted relative to the legs 1 on guide rails. Below the bearing housing 5 of the soft lower roll 7 is an actuator 8, preferably a hydraulic loading cylinder, having a piston rod 9 which is connected by means of an adapter piece 10 to the bearing housing 5 of the soft lower roll 7. The loading cylinder 8 is used to control the pressure in the nip formed between the two rolls 6, 7, and, when required, to open the nip during a web breakage or other disturbance. Alternatively, the rolls may be arranged in a different order, and the roll pair may alternatively comprise two hard or two soft rolls as required.

As shown in the cross-sectional view depicted in FIG. 5 which is taken along lines 5—5 in FIG. 4, the portion of the frame resting on the foundation 2, namely the bottom rail 30, is preferably comprised of a stiff hollow-section beam comprising two side plates 11, a bottom plate 12 and a top plate 13. The sides of the hollow-section beam are stiffened with J-shaped sections 3. The frame legs 1 are mounted into an opening formed in the bottom rail 30, with the bottom ends of the legs 1 resting on the bottom plate 12 of the bottom rail 30. The side plates 11 of the bottom rail 30 are attached to the sides of the legs 1. Hence, the bottom rail 30 forms a stiff structure which fixes the bottom ends of the legs 1 stationary in the foundation 2.

Referring to FIG. 4, the loading cylinder 8 is mounted by a specially designed beam structure to the frame. The sides of the loading cylinder 8 are provided with upright support plates 14, the upper edges of which are shaped to fit under the collar 18 of the loading cylinder 8. The upright support plates 14 are laterally connected by an L-section support member 19 located below the collar 18 of the loading cylinder 8 so that the cylinder 8 is supported on the support member 19. The upright support plates 14 are attached only at their ends to the frame. The height of the upright support plates 14 is slightly less than the height of the side plates 11 (as shown in FIG. 5). Consequently, the support plates 14 do not contact either the bottom or top plates 12, 13 of the bottom rail 30. The support plates 14 are shaped so that their ends act as pivotal joints when under load. The lower edges of the support plates 14 are provided with triangular cut-outs or cuts 15 positioned proximate their lower edges. The upper corners of the support plates 14 are also provided with stiffness-reducing cut-outs or cuts 16. The support plates 14 are secured at their ends to the inner walls 20 of the frame legs 1 so that their ends are supported from below by a cross-directionally mounted square-section beam 17 which is stiffly mounted to the frame and through which the force exerted by the loading cylinder 8 is transmitted to the side plate 11 of the frame leg via both attachment welding of the upper edge of the square-section beam 17 and the bottom plate 12, which is securely attached, such as by welding, to the frame leg 1.

The shape of the support plates 14 allows the plates to act under load as a pivotally jointed beam. In operation, when the loading cylinder 8 is activated so as to push the lower roll 7 upward, the support plates 14 yield slightly downward. The nature of the joint or connection between the support of the plates 14 and the frame legs 1 allows primarily only transverse and vertical force components to be transmitted to the frame upon the application of a loading force. The bending moments are substantially prevented from being transmitted to the frame. The vertical support forces are primarily transmitted through the inner walls 20 to the frame legs 1 rather than to the foundation 2. Consequently, the risk of damaging the connection between the foundation 2 and the frame is minimized.

The support structure for the loading cylinder 8 of the present invention may be implemented in a number of different manners. For example, the support structure may comprise a single beam mounted to the frame legs 1 which may be shaped as a curved bow. The support structure may be connected to the frame by means of a true pivotal joint, although a joint based on proper dimensioning and elastic deformation of the joint is easier to manufacture and assemble. Additionally, the support structure may be a hollow-section structure of various shapes. Also, the hydraulic cylinder used as the loading element may be replaced by an equivalent actuator capable of exerting a sufficiently high force, and there may be more than one loading cylinder.

Additionally, although the frame structure of the present invention is disclosed in conjunction with rollers used in paper manufacture, the frame may also be used in other machines where rolls that are pressed together are employed, such as in printing machines.

Thus, while there have been shown and described and pointed out fundamental novel features of the invention as applied to a preferred embodiment thereof, it will be understood that various omissions and substitutions and changes in the form and details of the device illustrated, and in its operation, may be made by those skilled in the art without departing from the spirit of the invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A frame structure for supporting a first roller and a second roller in a roll nip comprising:

two vertical legs, the rollers being rotatably supported on axes of the rollers between said legs so that the first roller is positioned above the second roller to form a roll nip, the first roller being fixed vertically between said legs, the second roller being capable of sliding vertically between said legs;

an actuator positioned between said legs and capable of vertically moving said second roller to control pressure in the roll nip; and a horizontal beam structure fixedly attached proximate to bottom ends of each of said legs, said actuator being mounted on said beam structure, said horizontal beam structure comprising:

a support plate upon which said actuator is mounted, said support plate having ends, the ends of said support plate being connected to each of said legs proximate to the bottom ends of each of said legs, portions of said support plate proximate to the ends thereof being sufficiently flexible so that, upon activation of said actuator to cause said second roller to move vertically, said support plate yields.

2. The frame structure of claim 1, wherein said support plate is jointed proximate to ends thereof.

3. The frame structure of claim 2, wherein said support plate has a cut-out proximate to ends thereof for increasing flexibility of said support plate and for forming a pivotal joint therein.

4. The frame structure of claim 1, wherein said horizontal beam structure further comprises square-section beams fixedly attached proximate to bottom ends of each of said legs and to ends of said support plate.

5. The frame structure of claim 4, further comprising a hollow-section bottom rail in which ends of said legs are mounted, said bottom rail having two side plates and a bottom plate, said bottom plate supporting ends of said legs, said side plates having a height greater than the height of said support plate, said support plate being mounted to said legs so that said support plate does not contact said bottom plate.

6. The frame structure of claim 5, wherein said support plate has a cut-out proximate to ends thereof for increasing flexibility of said support plate and for forming a pivotal joint therein.

7. The frame structure of claim 4, wherein said support plate has a cut-out proximate to ends thereof for increasing flexibility of said support plate and for forming a pivotal joint therein.

8. The frame structure of claim 1 wherein said support plate has a cut-out proximate to ends thereof for increasing flexibility of said support plate and for forming a pivotal joint therein.

* * * * *